US008714133B2

(12) United States Patent
Bicker et al.

(10) Patent No.: US 8,714,133 B2
(45) Date of Patent: May 6, 2014

(54) OIL PUMP HOUSING OF AN INTERNAL COMBUSTION ENGINE

(75) Inventors: Wolf-Dietrich Bicker, Trebur (DE); Andreas Moeritz, Ingelheim (DE)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/411,682

(22) Filed: Mar. 5, 2012

(65) Prior Publication Data

US 2012/0227702 A1 Sep. 13, 2012

(30) Foreign Application Priority Data

Mar. 7, 2011 (DE) ..... 10 2011 013 306

(51) Int. Cl.

| | |
|---|---|
| ***F01M 1/04*** | (2006.01) |
| ***F01M 1/02*** | (2006.01) |
| ***F01M 9/10*** | (2006.01) |
| ***F02B 25/06*** | (2006.01) |

(52) U.S. Cl.

USPC ..... 123/196 CP; 123/196 R; 123/196 M; 123/196 V; 123/41.86; 123/572; 123/573; 123/574

(58) Field of Classification Search

USPC ..... 123/196 R, 196 M, 196 V, 196 CP, 41.86, 123/572–574

See application file for complete search history.

(56) References Cited

U.S. PATENT DOCUMENTS

| | | | | |
|---|---|---|---|---|
| 6,205,970 | B1 | 3/2001 | Iwata et al. | |
| 6,334,438 | B1 * | 1/2002 | Itoh et al. | 123/572 |
| 6,412,478 | B1 * | 7/2002 | Ruehlow et al. | 123/572 |
| 6,443,136 | B1 * | 9/2002 | Suganami et al. | 123/572 |
| 6,471,008 | B1 | 10/2002 | Iwata | |
| 6,581,583 | B2 * | 6/2003 | Leen | 123/573 |
| 6,743,063 | B2 * | 6/2004 | Gokan | 440/88 L |
| 6,758,183 | B2 | 7/2004 | Endo et al. | |
| 6,868,820 | B2 * | 3/2005 | Rehr et al. | 123/196 R |
| 7,047,955 | B2 * | 5/2006 | Ookawa et al. | 123/572 |
| 7,243,642 | B2 * | 7/2007 | Nishikawa et al. | 123/572 |
| 8,307,802 | B2 * | 11/2012 | Marzy et al. | 123/192.2 |
| 2005/0193974 | A1 * | 9/2005 | Terada et al. | 123/196 R |
| 2006/0288976 | A1 * | 12/2006 | Watanabe | 123/196 R |
| 2008/0047521 | A1 | 2/2008 | Koyama | |
| 2009/0038575 | A1 * | 2/2009 | Ohsawa | 123/192.2 |
| 2010/0000490 | A1 * | 1/2010 | Marzy et al. | 123/192.2 |
| 2010/0012074 | A1 * | 1/2010 | Asaya | 123/196 A |
| 2012/0067320 | A1 * | 3/2012 | Kawamata et al. | 123/196 R |
| 2012/0227702 | A1 * | 9/2012 | Bicker et al. | 123/196 CP |

FOREIGN PATENT DOCUMENTS

| | | | |
|---|---|---|---|
| CA | 2597613 | A1 | 2/2008 |
| DE | 19754009 | A1 | 3/1999 |
| DE | 60024738 | T2 | 6/2006 |
| DE | 102008014828 | A1 | 9/2009 |
| JP | 2003184522 | A | 7/2003 |

* cited by examiner

*Primary Examiner* — Noah Kamen
*Assistant Examiner* — Tea Holbrook
(74) *Attorney, Agent, or Firm* — Ingrassia Fisher & Lorenz, P.C.

(57) ABSTRACT

An oil pump housing of an internal combustion engine flanged to a crankshaft housing, which includes, but is not limited to an oil pump housing wall. The oil pump housing has an oil collecting tray in an upper region of the oil pump housing wall. An oil return channel is integrated in the oil pump housing. An oil return channel extends from an oil inlet opening in the oil collecting tray as far as an oil outlet opening in an area below an oil pan level.

14 Claims, 4 Drawing Sheets

OIL PUMP HOUSING OF AN INTERNAL COMBUSTION ENGINE

CROSS-REFERENCE TO RELATED APPLICATION

This application claims priority to German Patent Application No. 10 2011 013 306.2, filed Mar. 7, 2011, which is incorporated herein by reference in its entirety.

TECHNICAL FIELD

The technical field relates to an oil pump housing of an internal combustion engine that can be attached by a flange to a crankshaft housing. The oil pump has a housing wall, and the oil pump housing has an oil collecting tray in an upper region of the oil pump housing wall.

BACKGROUND

Known from the document DE 600 24 738 T2 is a balance shaft housing with combined oil pump and angular momentum balance module for installation in an oil pan of a reciprocating piston engine, where a rotating angular momentum balance shaft carries counterweights at opposite ends in order to balance the unbalanced angular momentum forces of the reciprocating piston engine. It is further known from the document U.S. Pat. No. 6,205,970 B1 that the oil pump housing can be formed together with the housing of angular momentum balance shafts in order to thereby reduce the number of components and the manufacturing time of the assembly.

The known oil pump housing is located with its balance shaft housing at an angle below the crankshaft in such a manner that a suction opening of the oil pump lies in the oil pan and the counterweights rotate above the oil pan. In order to protect the combined oil pump and angular momentum balance module from oil of the crankshaft mounting, the oil pump and angular momentum balance module is completely encapsulated in the balance shaft housing from which only the oil suction opening of the oil pump projects into the oil pan.

It is at least one object to provide an improved oil pump housing. In addition, other objects, desirable features, and characteristics will become apparent from the subsequent summary and detailed description, and the appended claims, taken in conjunction with the accompanying drawings and this background.

SUMMARY

An oil pump housing of an internal combustion engine is provided according to one embodiment. The oil pump housing can be attached by a flange to a crankshaft housing. The oil pump housing has an oil pump housing wall. The oil pump housing has an oil collecting tray in an upper region of the oil pump housing wall. An oil return channel is integrated in the oil pump housing. The oil return channel extends from an oil inlet opening in the oil collecting tray as far as an oil outlet opening in an area below oil level in a pan. Oil of an oil separator located below a cylinder head cover can be conveyed in a gastight manner via the oil return channel as far as below the oil pan level.

The oil pump housing has the advantage that separated oil from a leakage combustion gas, also called "blow by gas" can be collected inside the oil pump housing, where the separated oil can be conveyed from the cylinder head as far as below oil level in the pan in the oil pump housing in a gastight manner. This also means a saving of assembly work for the mounting of additional components inside the oil pump housing such as gastight oil pipelines which have screw connections for fixing. In addition, the safety and reliability of an internal combustion engine is increased since no screw connections of the fixing of the components for oil return can become loose due to vibrations in the area of the oil pump housing and for example, can no longer impair the function of oil pump and angular momentum balance shaft.

In addition, it is advantageous that the number of parts is significantly reduced compared with conventional solutions. Since such an integrated oil return channel can be integrated when die casting the pump housing, no through holes for the oil separated from the leakage combustion gas are required subsequently for the attachment of components for oil return and components which hold and carry the oil such as oil return pipes.

In a further embodiment, the oil inlet opening has a gas seal via which the oil inlet opening is connected to a gastight oil inlet channel integrated in the crankshaft housing in a gastight manner. This seal is an integral component of the flat seal between crankshaft housing and oil pump housing and ensures that no oil mist and no gas pressure from the crankshaft housing can penetrate into the reduced-pressure oil return channel for the separated oil from the volume of the cylinder head cover. For this purpose the oil separator itself can be disposed in the volume of the cylinder head cover or in a transition zone to a gastight oil inlet channel integrated in the crankshaft housing. Such a gastight oil inlet channel integrated in the crankshaft housing conveys the separated oil at reduced pressure as far as the oil inlet opening in the oil collecting tray of the oil pump housing.

In a further embodiment, if the oil pump housing wall is open at the bottom in its lower region, the oil pump housing wall is terminated in this lower region in an oil-tight manner by a flange-mountable oil pan bottom. The oil pan bottom therefore covers this lower open region of the oil pump housing in an oil-tight manner.

The oil outlet opening of the oil return channel is located below oil level in the pan and can ensure that the oil separated from the leakage combustion gas is reliably returned into the oil pan at reduced pressure. In order to collect the oil separated from the leakage combustion gas which reaches the oil collecting tray through the gastight oil inlet channel of the crankshaft housing, the oil inlet opening in the oil collecting tray goes over into a funnel-shaped cavity. This funnel-shaped cavity can collect the oil to form oil drops or to form an oil return flow so that at the end of the funnel-shaped cavity a transition to a horizontally aligned oil collecting channel is possible. This oil collecting channel can also be designed to be bent in order to connect the oil inlet opening of the oil collecting tray with the oil outlet opening in the area below the oil pan level.

To this end, in a further embodiment, the horizontally aligned oil collecting channel goes over into a vertical oil drain channel to the oil outlet opening. The cross-sections of these horizontal and vertical channels can be significantly reduced compared with the funnel-shaped opening in the spray collecting tray if the oil outlet opening is not to be used as an oil opening. To this end, it can be provided that the vertical oil drain channel to the oil outlet opening is integrated in the oil pump housing wall. Due to this integration in the oil pump housing wall, the casting of a vertically aligned hollow tube into the end of the horizontal collecting channel can be dispensed with.

An oil pump module comprising an oil pump and an angular momentum balance shaft can be located in the oil pump housing. Whereas the oil pump has a suction opening that projects into the oil pan in order to pump oil to the friction and shaft bearings of the crankshaft, at least one counterweight is disposed in a rotating manner on an angular momentum balance shaft of the oil pump module in order to compensate for an imbalance caused by angular momentum pulses of the internal combustion engine. To this end, a rotor shaft is connected mechanically to the angular momentum balance shaft via a spur gear transmission in the oil pump housing. It is further provided that the oil pump housing can be used in a vehicle with an internal combustion engine.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
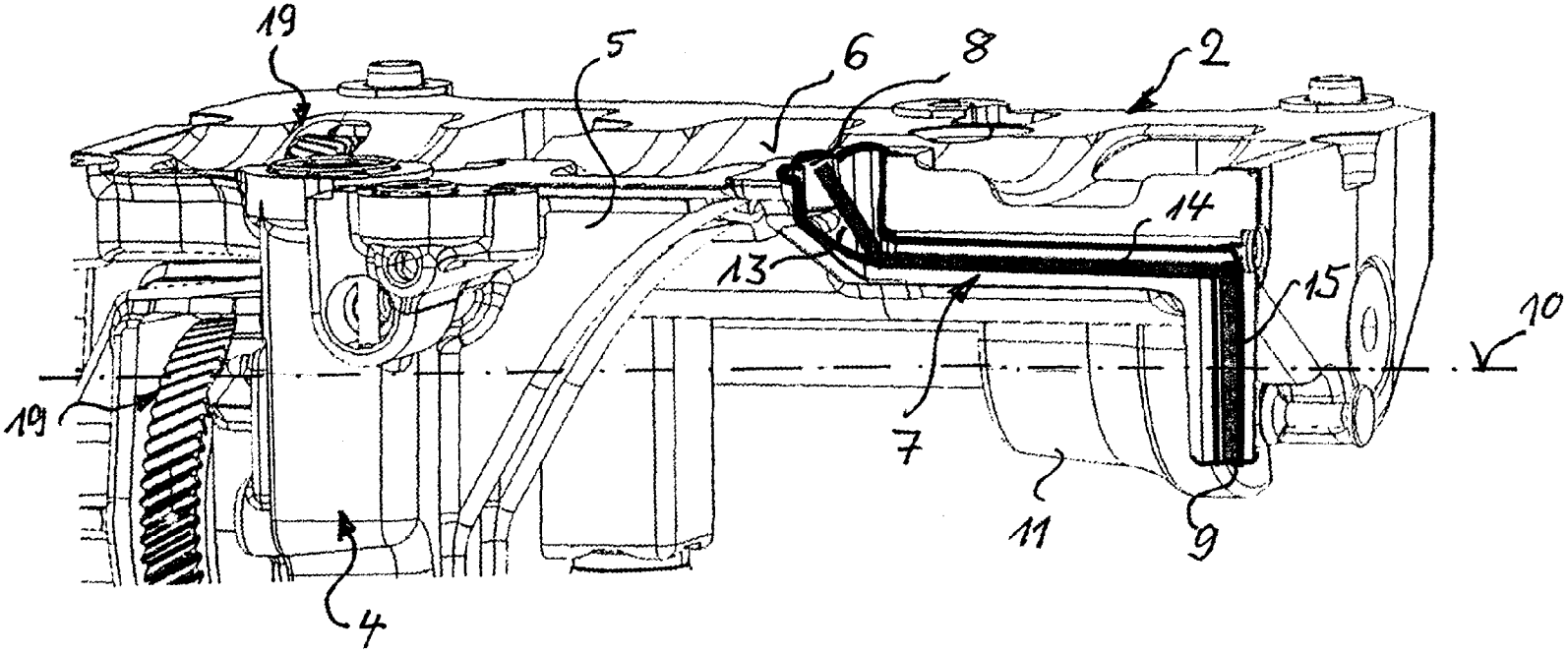
FIG. 1 shows a schematic perspective view of an oil pump housing.

FIG. 1 shows a schematic perspective view of an oil pump housing 2 according to one embodiment. In the oil pump housing 2 there is an oil pan which has oil level in a pan 10 which in FIG. 1 is marked by a dot-dash line. The oil pump housing 2 has an oil pump housing wall 4 that is terminated in its upper region 5 by an oil collecting tray 6 and in a lower region 11 has an oil pan bottom, not shown in FIG. 1, which closes a lower opening of the oil pump housing wall 4 in an oil-tight manner.

In this embodiment according to FIG. 1 an oil return channel 7 is integrated in the oil pump housing 2 that extends from an oil inlet opening 8 in the oil collecting tray 6 as far as an oil outlet opening 9 below oil level in the pan 10. The oil return channel 7 has a funnel-shaped cavity 13 in the area of the oil inlet opening 8 which goes over into a horizontally aligned oil collecting channel 14. The horizontally aligned oil collecting channel 14 is adjoined by a vertical oil drain channel 15 at the end of which the oil outlet opening 9 is located. Oil escaping from friction and roller bearings in a crankshaft region is collected on the oil collecting tray 6 of the oil pump housing 2 and fed via the oil inlet opening 8 to the oil return channel 7.

This oil return channel 7 is an integral component of the oil pump housing 2 that can consist of an aluminum die-cast alloy. Such an integral oil return channel 7 can be incorporated in the oil pump housing 2 by an aluminum die casting method so that a subsequent installation of oil return components from the oil collecting tray 6 as far as the oil pan can be completely omitted, whereby assembly costs are reduced. Such an oil return channel 7 integrated in the oil pump housing 2 at the same time improves the reliability of the oil return, especially as no screw fixings are required for additional components within the oil return. In addition, a spur gear transmission 19 with helical gearing can be seen in sections in FIG. 1, via which an angular momentum balance shaft 17 shown in FIG. 2 is driven.

Figure 2:
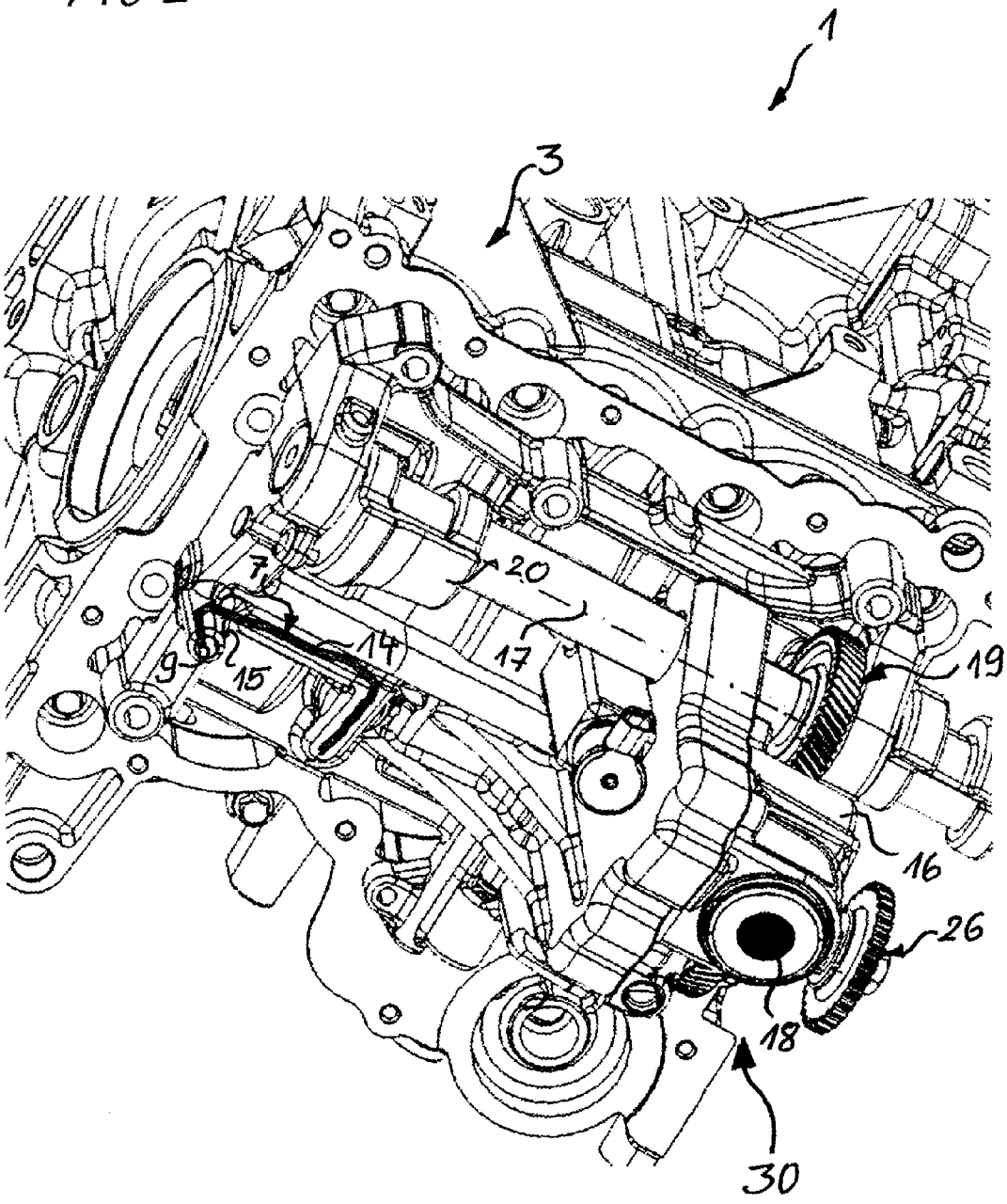
FIG. 2 shows a schematic view from below of an oil pump module according to FIG. 1 without surrounding oil pump housing wall.

FIG. 2 shows a schematic view from below of an oil pump module 30 according to FIG. 1 without surrounding oil pump housing wall. The oil pump module 30 with its assemblies such as an oil pump 16 having a suction opening 18 penetrating into the oil pan and having a spur gear drive 26 as well as the angular momentum balance shaft 17 and at least one counterweight 20, covers almost the entire underside of the oil collecting tray 6 shown in FIG. 1 so that the oil return channel 7 built integrally into the oil pump housing with its horizontally aligned oil collecting channel 14 and the vertical oil drain channel 15 makes a significant contribution to saving space within the oil pump housing.

Figure 3:
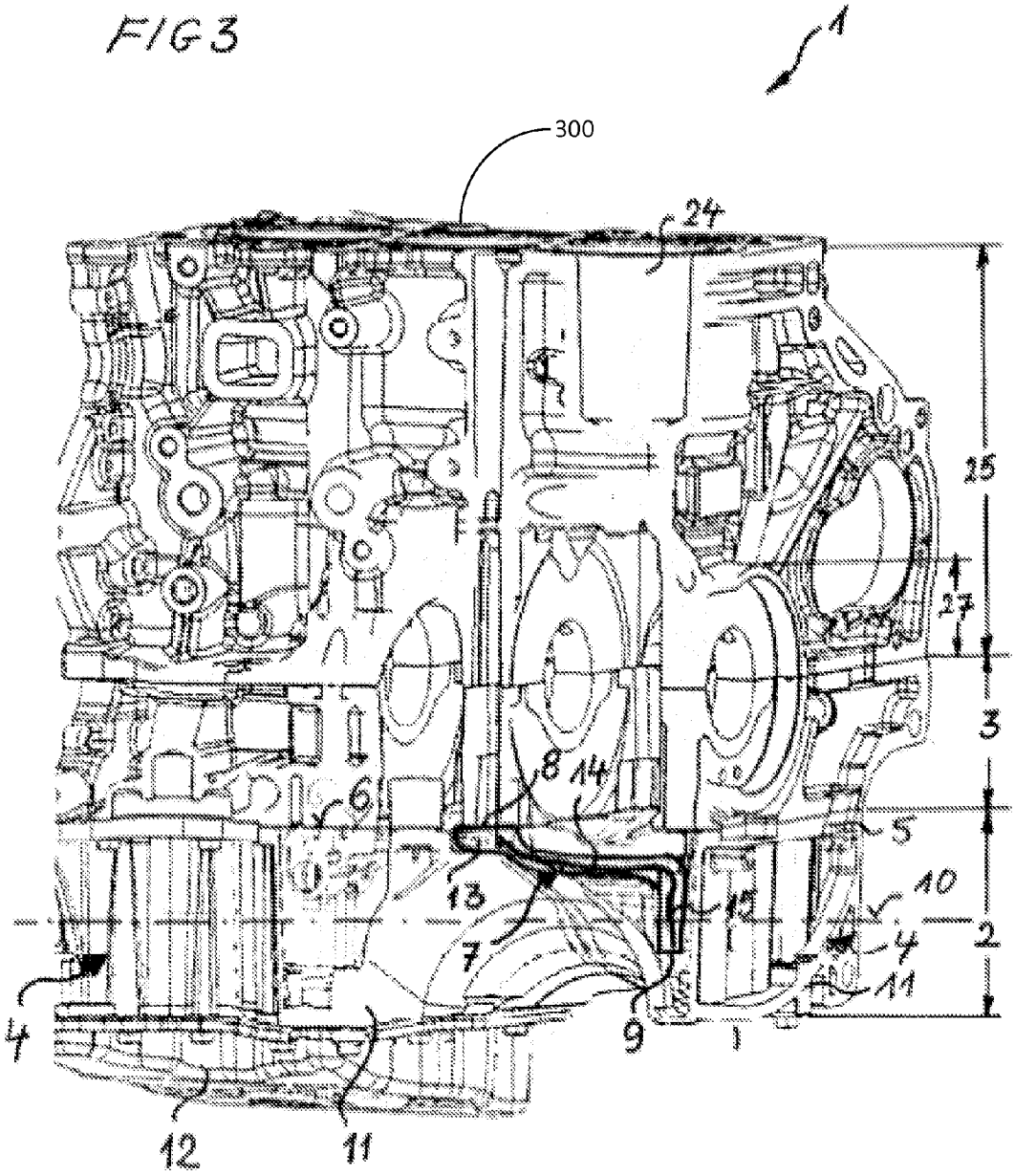
FIG. 3 shows a schematic partially cutaway perspective partial view of an internal combustion engine with oil return channel according to FIG. 1.

FIG. 3 shows a schematic, partially cutaway perspective partial view of an internal combustion engine 1 with an oil return channel 7 according to FIG. 1. This partial view of the internal combustion engine 1 shows a section through one of the cylinders 24 of a cylinder block 25 which also covers the upper crankshaft housing region 27 of the internal combustion engine 1. As discussed above, an oil separator 300 is situated below a cylinder head cover (not illustrated). The cylinder block 25 with the upper crankshaft housing region 27 is adjoined by a lower crankshaft housing 3. The oil pump housing 2 with its oil collecting tray 6 is attached by a flange to the lower crankshaft housing 3, where the oil pump housing wall 4 is terminated in an oil-tight manner in a lower region 11 by an oil pan bottom 12.

In this embodiment this oil pan bottom 12 is formed from a deep drawn sheet metal plate. In the sectional plane of the cylinder 24, at the same time it is possible to see a section through the oil return channel 7 integrated in the oil pump housing 2, the funnel-shaped cavity 13, the horizontally aligned oil collecting channel 14, and the vertically adjoining oil drain channel 15 as far as the oil outlet opening 9, which in this embodiment are located below oil level in the pan 10.

Figure 4:
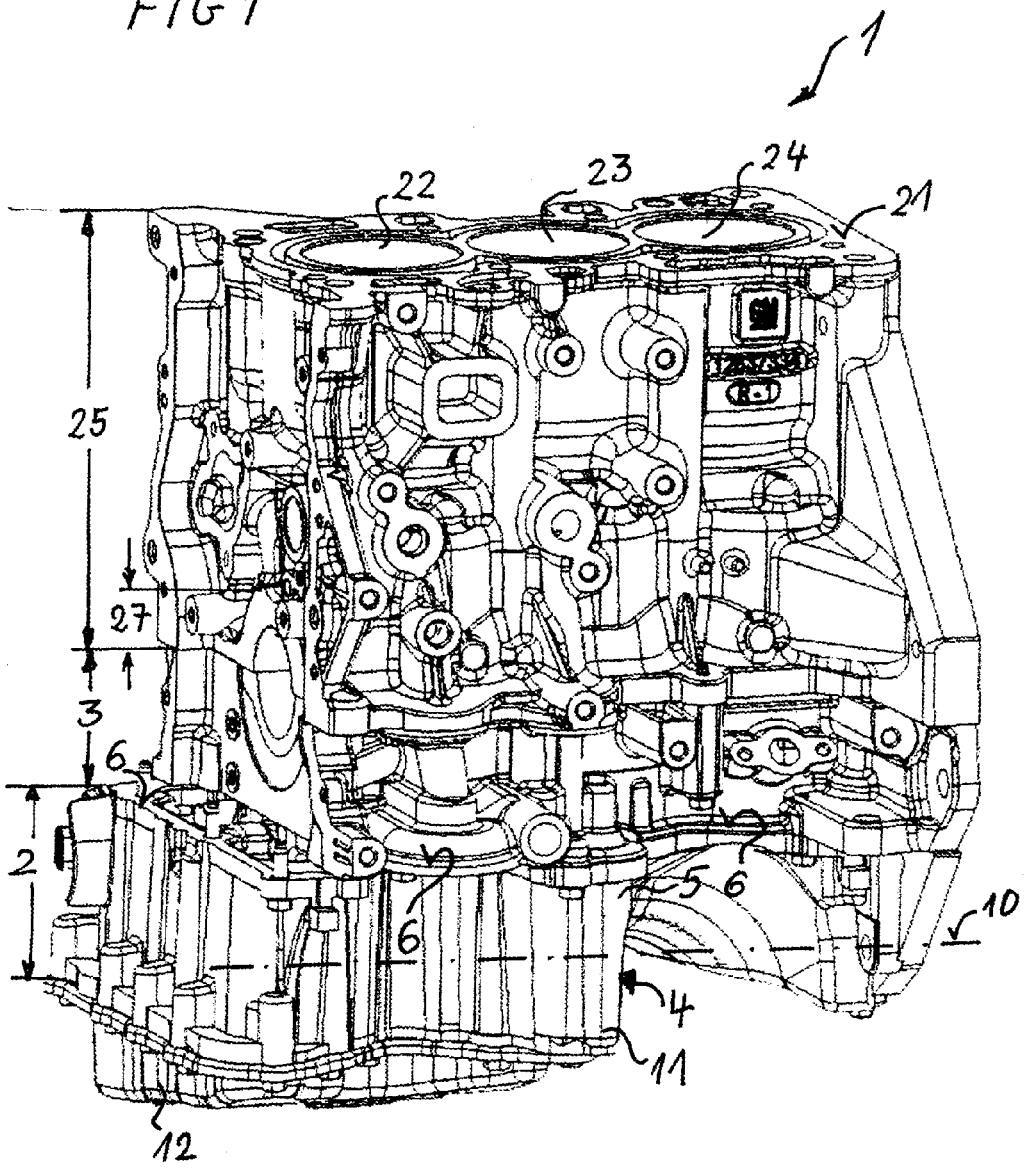
FIG. 4 shows a schematic perspective partial view of an internal combustion engine.

FIG. 4 shows a schematic perspective partial view of the internal combustion engine 1 according to FIG. 3 that in this embodiment comprises three cylinders 22, 23, and 24 in the cylinder block 25. Furthermore, a cylinder head seal 21 can be seen in FIG. 4 that seals in a gastight manner a connection between the cylinder block 25 shown here and a cylinder head not shown. Components having the same functions as in FIG. 1 to FIG. 3 are identified with the same reference numbers and not explained again.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. An oil pump housing in an internal combustion engine that is configured to be attached by a flange to a crankshaft housing, comprising:

an oil pump housing wall;

an oil collecting tray terminating the oil pump housing wall in an upper region; and an integrated oil return channel that extends from an oil inlet opening in the oil collecting tray as far as an oil outlet opening in an area below oil level in a pan; and arranged to convey oil from an oil separator located below a cylinder head cover sealing the oil pump housing in a substantially gastight manner to the oil pan.

2. The oil pump housing according to claim 1, wherein the oil inlet opening comprises a gas seal that is configured to connect the oil inlet opening to a gastight oil inlet channel integrated in the crankshaft housing in a substantially gastight manner.

3. The oil pump housing according to claim 2, wherein the gastight oil inlet channel integrated in the crankshaft housing extends from the cylinder head cover as far as the oil inlet opening and configured to convey oil in a gastight manner to the oil inlet opening.

4. The oil pump housing according to claim 1, wherein the oil separator located in a volume of the cylinder head cover separates oil from a leakage combustion gas in the gastight oil inlet channel integrated in the crankshaft housing.

5. The oil pump housing according to claim 1, further comprising a flange-mountable oil pan bottom that is configured to terminate the oil pump housing wall in a lower region in a substantially oil-tight manner by a flange-mountable oil pan bottom.

6. The oil pump housing according to claim 5, wherein the oil inlet opening in the oil collecting tray goes over into a funnel-shaped cavity.

7. The oil pump housing according to claim 6, wherein the funnel-shaped cavity goes over into a horizontally aligned oil collecting channel.

8. The oil pump housing according to claim 6, wherein the horizontally aligned oil collecting channel is bent.

9. The oil pump housing according to claim 8, wherein the horizontally aligned oil collecting channel goes over into a vertical oil drain channel to the oil outlet opening.

10. The oil pump housing according to claim 1, wherein the vertical oil drain channel to the oil outlet opening is integrated in the oil pump housing wall.

11. The oil pump housing according to claim 1, wherein an oil pump module comprising an oil pump and an angular momentum balance shaft that is located in the oil pump housing.

12. The oil pump housing according to claim 11, wherein a suction opening of the oil pump of the oil pump housing is located below the oil level in the pan.

13. The oil pump housing according to claim 11, wherein a rotor shaft is mechanically connected to an angular momentum balance shaft via a spur gear transmission in the oil pump housing.

14. The oil pump housing according to claim 11, wherein at least one balance counterweight is located on the angular momentum balance shaft that is configured to compensate for imbalance due to angular momentum impulses of the internal combustion engine.

* * * * *